US006171023B1

(12) United States Patent
Townshend

(10) Patent No.: US 6,171,023 B1
(45) Date of Patent: Jan. 9, 2001

(54) WATER CONTROL GATE

(76) Inventor: Peter Douglas Townshend, 28 Peking Avenue, Blairgowrie, Randburg, 2194 (ZA)

( * ) Notice: Under 35 U.S.C. 154(b), the term of this patent shall be extended for 0 days.

(21) Appl. No.: 09/117,836

(22) PCT Filed: Feb. 12, 1997

(86) PCT No.: PCT/AU97/00077

§ 371 Date: Nov. 3, 1998

§ 102(e) Date: Nov. 3, 1998

(87) PCT Pub. No.: WO97/30230

PCT Pub. Date: Aug. 21, 1997

(30) Foreign Application Priority Data

Feb. 12, 1997 (ZA) ..... 96/1109

(51) Int. Cl.[7] ..... E02B 7/40; E02B 7/42

(52) U.S. Cl. ..... 405/94; 405/87; 405/92; 405/93; 405/99; 405/100

(58) Field of Search ..... 405/87, 92, 93, 405/94, 99, 100

(56) References Cited

U.S. PATENT DOCUMENTS 2,984,986 * 5/1961 Hill ..... 405/93
4,836,711 * 6/1989 Sala et al. ..... 405/92
4,877,352 * 10/1989 Tuttle et al. ..... 405/100
5,372,456 * 12/1994 Langemann ..... 405/92
5,516,230 * 5/1996 Bargeron et al. ..... 405/92
5,577,863 * 11/1996 Nottle ..... 405/99

FOREIGN PATENT DOCUMENTS

2501747 * 9/1982 (FR) ..... 405/94
0670674 * 6/1979 (SU) ..... 405/92

* cited by examiner

*Primary Examiner*—Eileen D. Lillis
*Assistant Examiner*—Alexandra K. Pechhold
(74) *Attorney, Agent, or Firm*—Blakely, Sokoloff, Taylor & Zafman

(57) ABSTRACT

A water control gate assembly comprises a self-actuating top-hung gate for controlling the flow of water in a waterway. The gate is pivotably mounted on a pair of piers located above an upstream of the gate for allowing the gate to pivot between a closed position and an open position in which water flows beneath the gate. The gate includes a ballast tank having an upstream inlet for charging the ballast tank and a downstream outlet for discharging the ballast tank. The upstream inlet is arranged to start charging the ballast tank with water in the event of the upstream water level reaching a first lower level. The downstream outlet is arranged to start discharging the ballast tank in the event of the upstream water level reaching a second upper level, with the ingress of water into the ballast tank between the first and second levels progressively increasing the closing moment of the gate and maintaining it closed against the progressively increasing opening moment of upstream water pressure against the gate.

18 Claims, 8 Drawing Sheets

3a
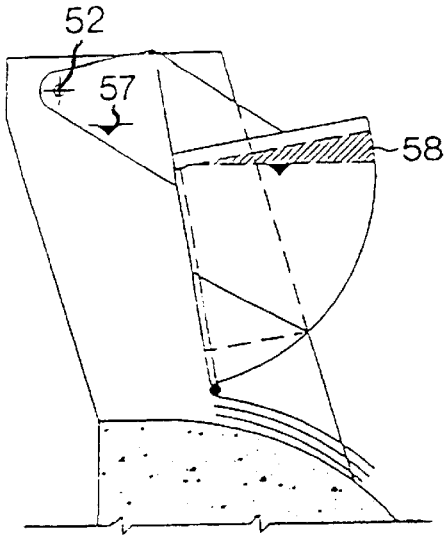
3b
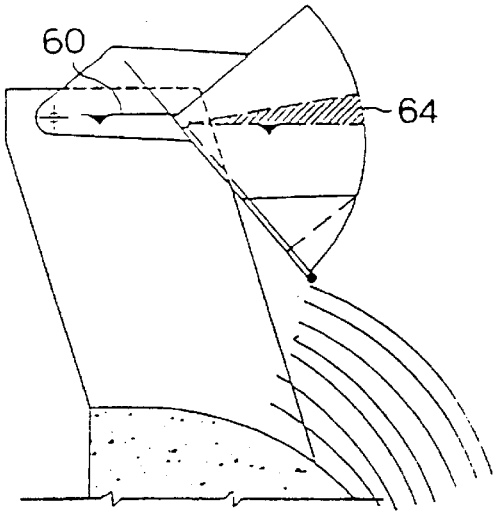
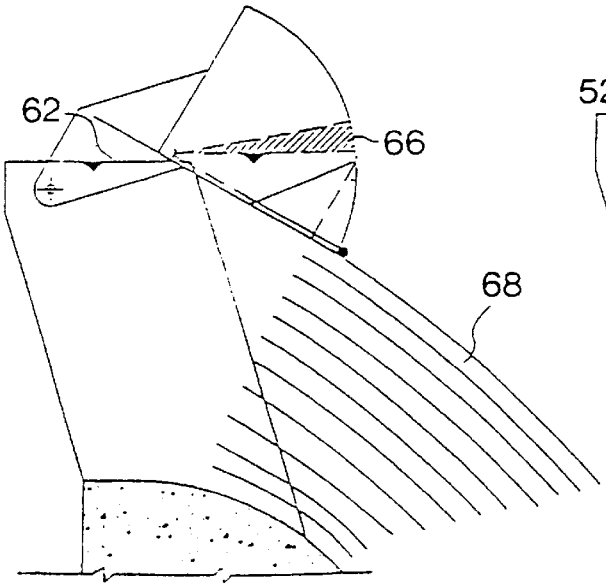
3c
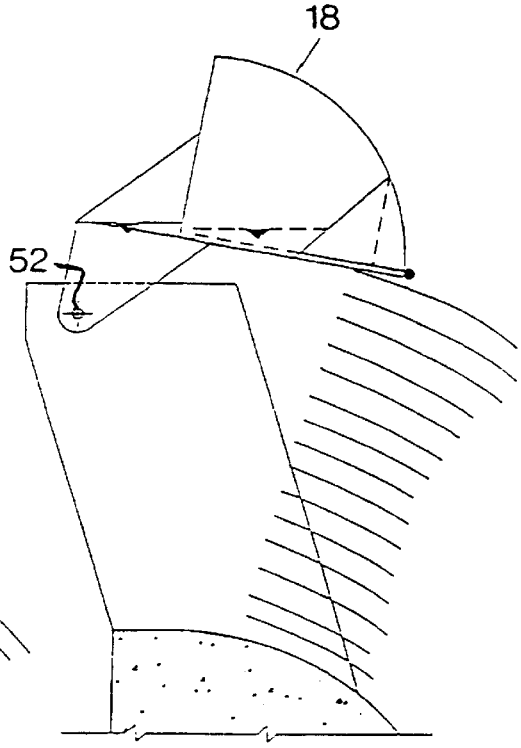
3d

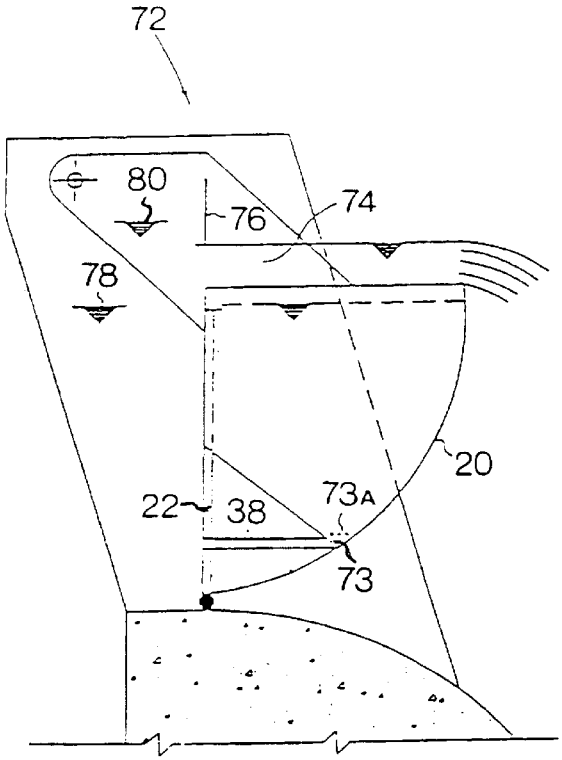
4
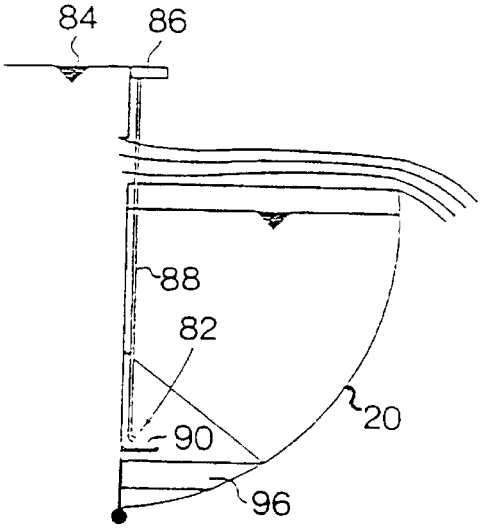
5a
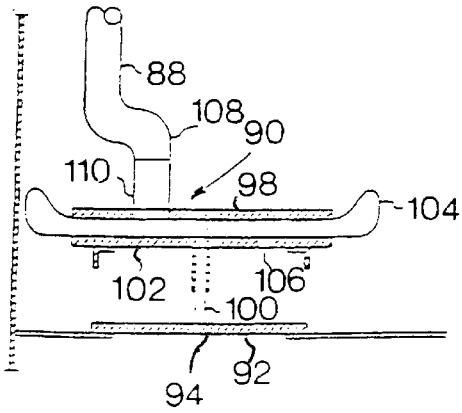
5b
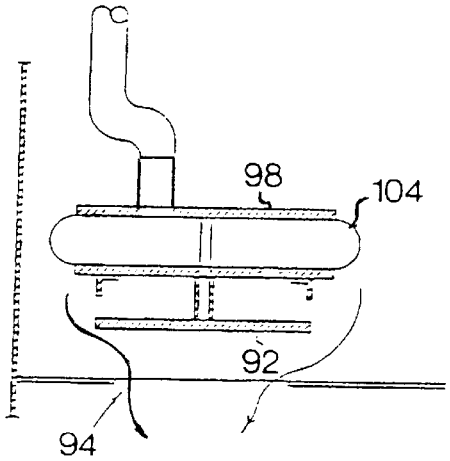
5c

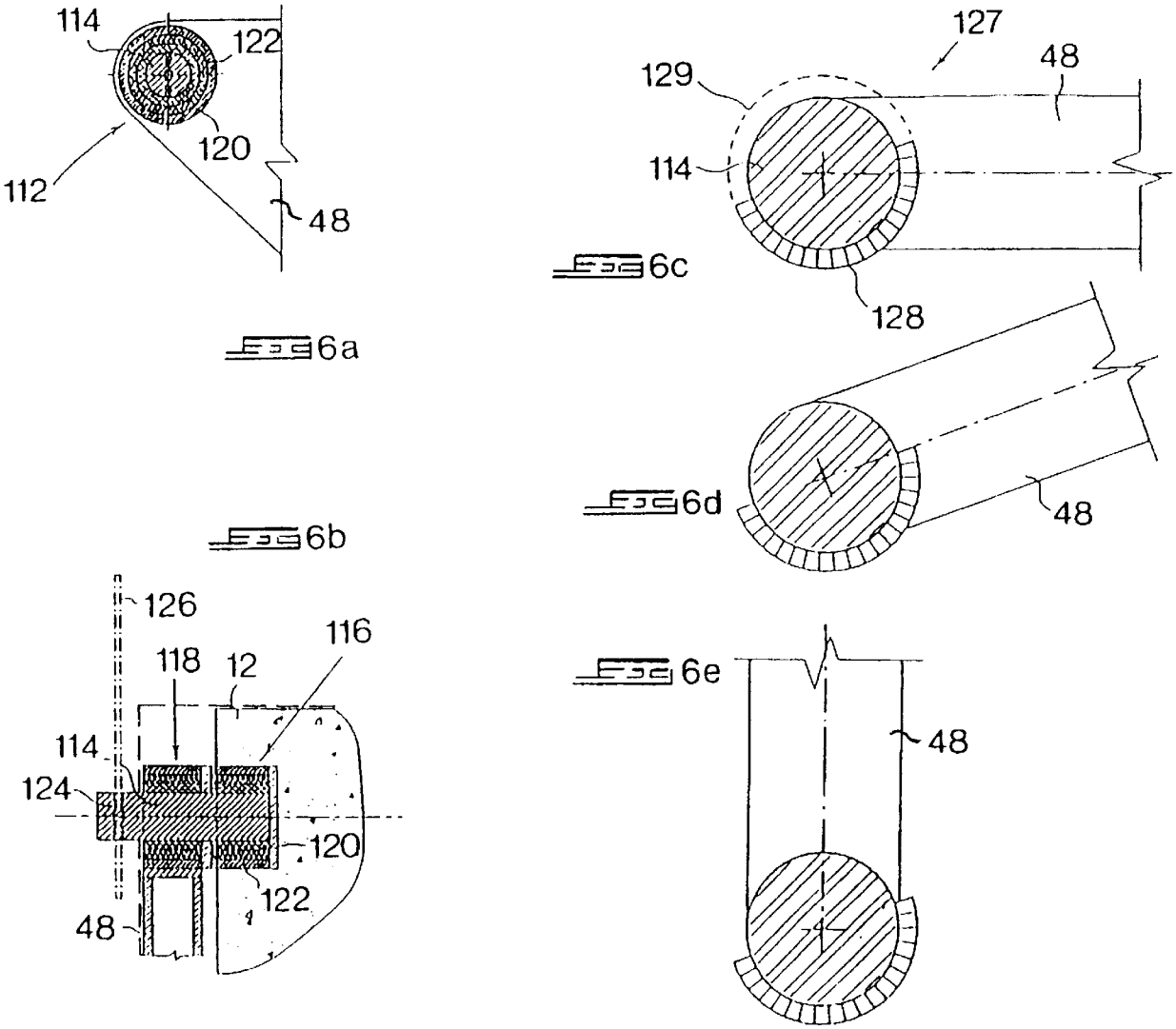
48
122
120
114
112
6a
116
120
122
12
118
126
114
124
48
6b
127
48
128
129
114
6c
48
6d
48
6e

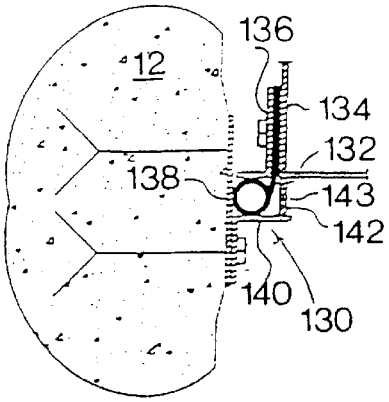
7a
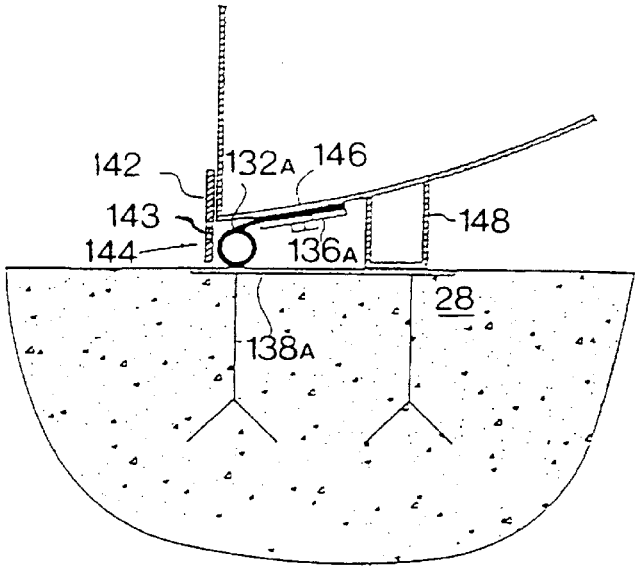
7b
8a
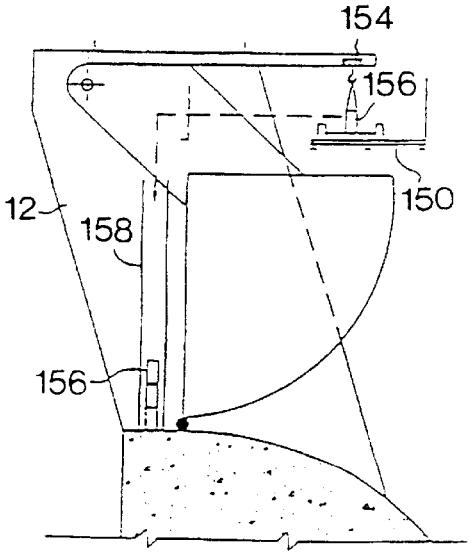
8b
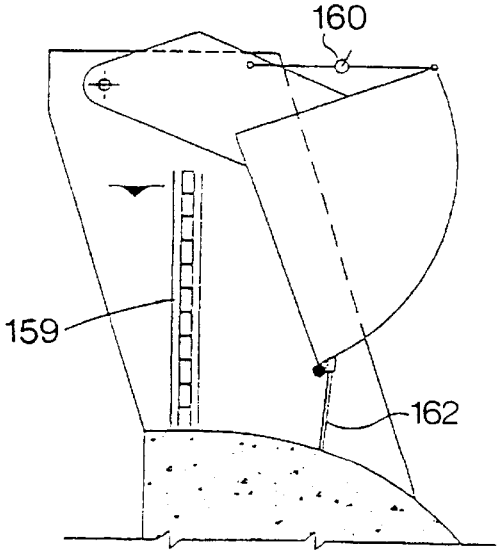

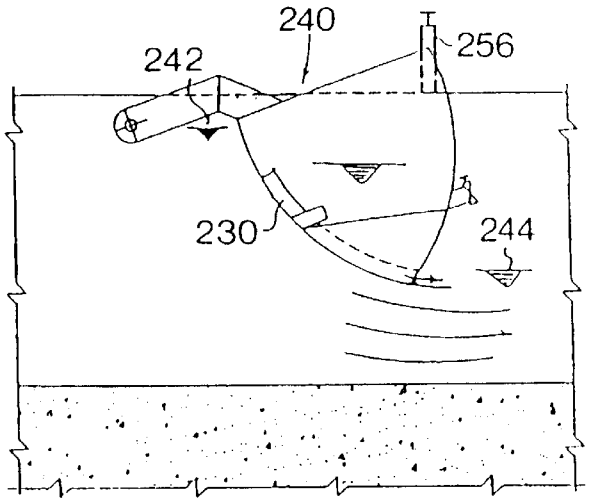
14a
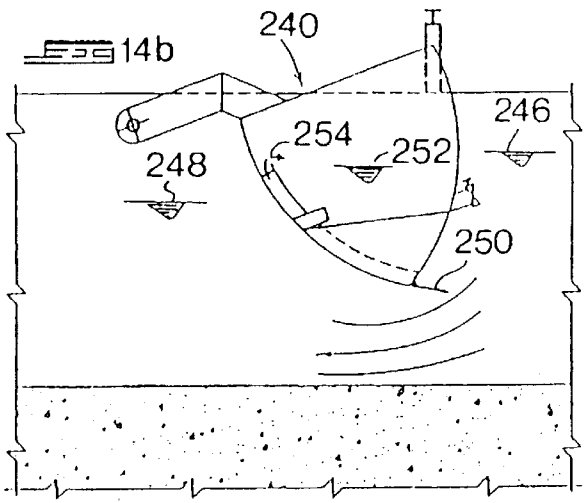
14b
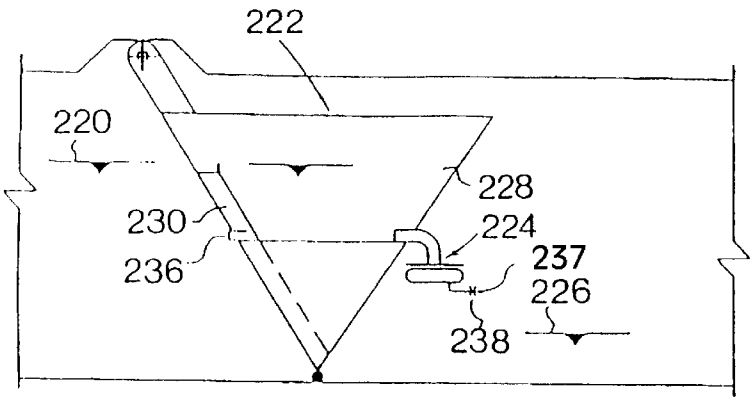
13a
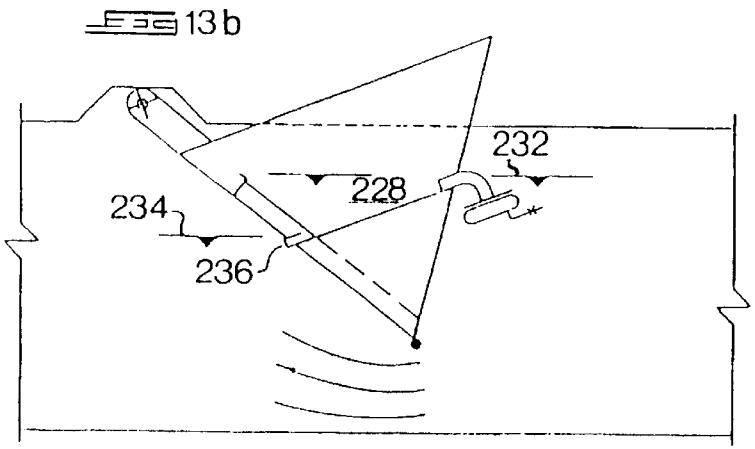
13b

WATER CONTROL GATE

BACKGROUND TO THE INVENTION

This invention relates to a water control gate assembly, and in particular to a self-actuating automatic top-hung gate for controlling the flow and/or water level in a waterway.

In water supply schemes, and in particular irrigation schemes relying on the upstream control of water, various types of water control gates are currently in use. These extend from simple manually operated sluice gates to highly complicated automatic control gates for operating electronically or mechanically operated hydraulic equipment in response to various electronic water level and flow sensors. Most water control gates require human intervention, which add significantly to their operating costs. Further, many water control gates only tend to operate effectively under normal flow conditions, and not flood conditions. More sophisticated gates which are hydraulically or mechanically operated are prone to failure, and require regular maintenance, as well as access to a power source.

SUMMARY OF THE INVENTION

According to the invention there is provided a water control gate assembly comprising a self-actuating top-hung gate for controlling the flow and/or level of water in a waterway, a pivot arrangement located above and upstream of the gate for allowing the gate to pivot between a closed position and an open position in which water flows beneath the gate, the gate including a ballast tank having an upstream inlet for charging the ballast tank so as to increase the closing moment of the gate and a downstream outlet for discharging the ballast tank so as to decrease the closing moment of the gate.

Preferably, the upstream inlet is arranged to start charging the ballast tank with water in the event of the upstream water level reaching a first lower level, and the downstream outlet is arranged to start discharging the ballast tank in the event of the upstream water level reaching a second upper level. with the ingress of water into the ballast tank between the first and second levels progressively increasing the closing moment of the gate and maintaining it closed against the progressively increasing opening moment of upstream water pressure against the gate.

Conveniently, the gate is arranged to start opening when the water level approaches the second upper level, the downstream outlet being configured to progressively discharge water from the ballast as the gate tilts progressively upwards.

The upstream inlet, the downstream outlet and the ballast tank are arranged to operate in the opposite manner on closure of the gate, with the upstream inlet progressively filling the tank and the downstream outlet no longer being capable of discharging water as the gate pivots downwards.

Conveniently, the ballast tank occupies an upper portion of the gate, and a lower portion of the tank comprises a buoyancy chamber or tank which is separated from the ballast tank by means of a wall which slopes downwardly from the upstream to the downstream side of the gate.

Typically, the water control gate assembly comprises a pair of supports, such as piers, located on opposite sides of the gate, the pivot arrangement including pivot shaft assemblies pivotably connecting each pier to the top-hung gate via upwardly and rearwardly extending arms.

The gate may be formed with side and bottom seal arrangements for sealing the respective sides and base of the gate against the respective inner side walls of the supports and the bed of the waterway.

In one form of the invention, in which the water control gate assembly is in the form of a spillway crest gate, the gate is formed with a spillway outlet above the ballast tank for discharging water over the gate without opening it. A baffle plate may be located above the spillway outlet so as to limit the depth of free discharge before the gate starts opening.

Conveniently, the gate is formed with an emergency discharge valve which is arranged to void the ballast tank in the event of the gate failing to open after it has reached a third flood level which is higher than the second upper level.

In another form of the invention, in which the water control gate assembly is in the form of a weir scour gate, the downstream outlet may comprise a syphon arrangement which allows for almost complete discharging of the ballast tank after priming of the syphon arrangement so as to cause rapid opening of the gate.

In another form of the invention, a level control canal gate, the downstream outlet is provided with valve means responsive to close the outlet in the event of the downstream water level reaching a predetermined upper level, thereby allowing the ballast tank to fill and to increase the closing moment of the gate. The valve means is further arranged to open the outlet in the event of the downstream water level falling below a predetermined lower level, thereby to increase the opening moment of the gate.

In yet another form of the invention, an estuarine control gate, the gate is arranged to open in response to the downstream water level exceeding the upstream water level.

In a still further form of the invention, a tidal control gate, the gate is arranged to close in the event of the downstream water level exceeding the upstream level by a predetermined increase in downstream or seaward level of water.

BRIEF DESCRIPTION OF THE DRAWINGS

FIGS. 3A to 3D show various stages in the opening of the top-hung gate from a partly open position to an extreme flood position;

FIG. 4 shows a cross-sectional side view of a spillway crest gate forming a first main embodiment of a top-hung gate of the invention;

FIG. 5A shows a schematic side view of the gate of FIG. 4 incorporating an emergency diaphragm valve;

FIGS. 5B & 5C show detailed views of the emergency diaphragm valve in the closed and open positions;

FIGS. 6A & 6B show respective detailed cross-sectional end-on and side views of a pivot shaft assembly forming part of the top-hung gate;

FIGS. 6C to 6E show cross-sectional end-on views of an alternative pivot shaft assembly;

FIGS. 7A & 7B show cross-sectional details of respective side and bottom seals forming part of the top-hung gate;

FIGS. 8A & 8B show schematic side views of various steps involved in maintaining the top-hung gate of the invention;

FIGS. 13A & 13B show schematic side views of a fourth main embodiment of a top-hung gate of the invention in the form of estuarine control gate in the respective closed and open positions; and FIGS. 14A & 14B show schematic side views of a fifth main embodiment of a top-hung gate of the invention in the form of a tidal control gate operating to control respective outgoing and incoming tides.

DESCRIPTION OF EMBODIMENTS

Figure 2A:
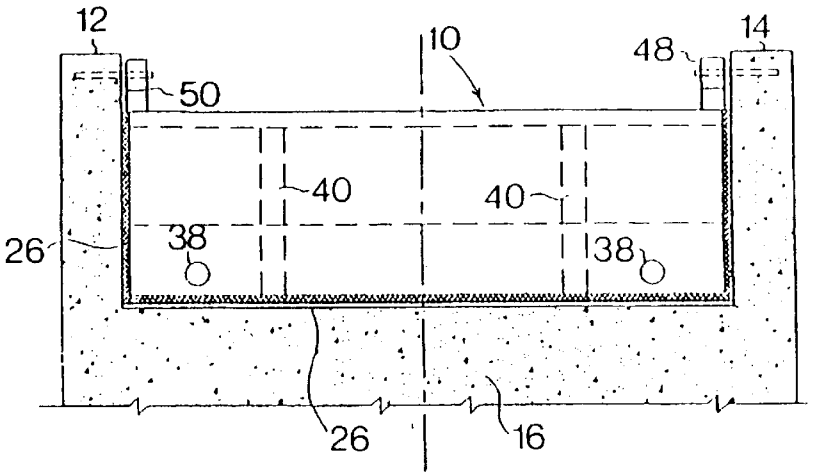
FIGS. 2A & 2B show respective upstream and downstream elevations of the gate of FIG. 1.
Figure 2B:
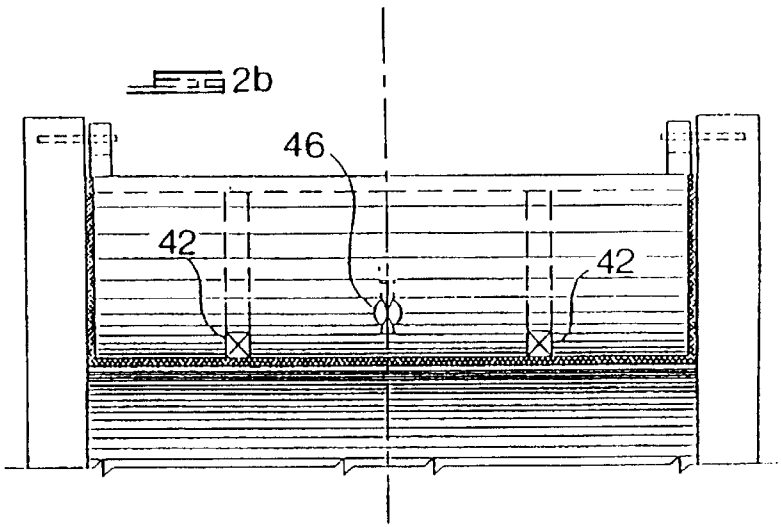
Figure 1:
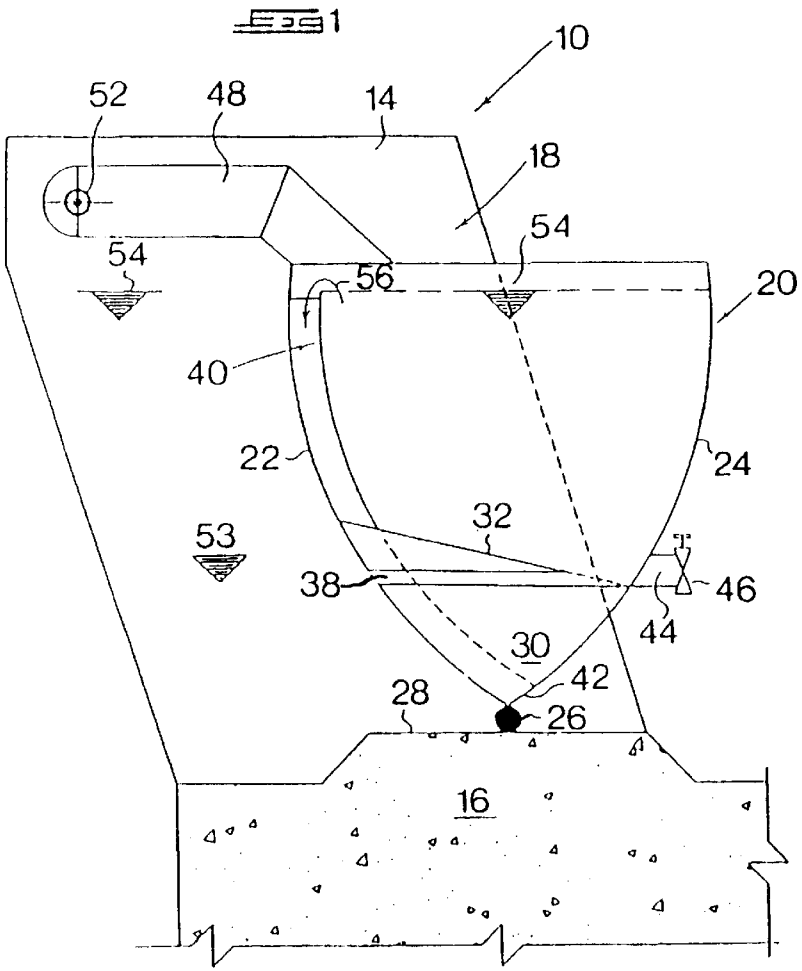
FIG. 1 shows a cross-sectional side view of a basic embodiment of a top-hung gate of the invention.

Referring first to FIGS. 1 to 2B, the first embodiment of a water control gate assembly 10 comprises a pair of piers 12 and 14 which extend upwardly from an outlet structure such as a dam spillway 16. A top-hung gate 18 includes a ballast tank 20 formed with opposed convex upstream and downstream walls 22 and 24. An elongate seal element 26 is fitted to the base and sides of the gate at the confluence of the walls, and is arranged to provide a seal between the gate and the top surface 28 of the spillway 16, as well as against the sides of the piers 12 and 14. The top-hung gate includes a lower void portion or buoyancy tank 30 which is separated from the ballast tank by means of a dividing wall 32 which slopes downwardly from the upstream wall 22 to the downstream wall 24 at an angle of depression of approximately 45°. The ballast tank 20 is formed with a pair of spaced apart upstream water inlet pipes 38 and a pair of outlet launders 40 which extend from near the top of the upstream wall 22 to an outlet 42 at the base of the downstream wall 24. The ballast portion 20 is also provided with a second outlet 44 which is fitted with a manually or mechanically operated valve 46 discharging to the downstream side of the gate. The top-hung gate 18 is pivotably connected to the support piers 12 and 14 by means of rearwardly and upwardly extending arms 48 and 50 terminating in pivot points 52.

In the closed position illustrated in FIG. 1, the gate assembly serves to close off a waterway thereby holding back a body of water 53 up to a required water level. Up to the level of the water inlet pipes 38, the weight of the gate and the downward moment it produces about the pivot points 52 is sufficient to maintain the gate in a closed position. As the water level rises above the inlet pipes 38, water flows into the ballast tank 20 from the upstream water body 53, thereby increasing the closing moment of the gate and ensuring that it stays closed against the increased pressure of the upstream body of water 53.

If the manual valve 46 is closed and the inlet 38 is open, the water level in the ballast tank 20 will rise with the upstream water level. Once the water reaches the level 54 in the ballast tank, it is discharged in the direction of arrow 56 through the discharge overflow launders 40 and the downstream outlet openings 42. As the inlets 38 have a smaller capacity than the overflow launder 40, water will not rise above the level 54 in the ballast portion 20. When the water is at the level 54, the opening moment created by the water body 53 just balances the closing moment created by the top-hung gate. As a result, when the water level rises further to a level 57 illustrated in FIG. 3A, the aforementioned opening moment just exceeds the closing moment, as a result of which the top-hung gate 18 rotates about the pivot points 52 in an anti-clockwise direction. This results in the gate opening from the bottom so as to allow water to flow between the bottom of the outlet structure and the seal. In addition, a volume of water 58 is decanted through the overflow launder 40, thereby lightening the ballast tank and further assisting in the opening action of the top-hung gate.

The top-hung gate opens progressively in the manner illustrated in FIGS. 3B and 3C as the water arises to levels 60 and 62 respectively, thereby decanting further volumes of water 64 and 66, and allowing even more water to be released from between the gate and the spillway, as is shown at 68. In FIG. 3D, the top-hung gate 18 is shown in the fully raised position which corresponds to an extreme flood condition such as regional maximum flood in which the gate assembly 18 is higher than the pivot points 52. The gate is thus able to accommodate most flood conditions by pivoting progressively upwards in response to an increase in water level.

Lowering of the top-hung gate takes place in the reverse order. As the water level on the upstream side recedes from positions 3D to 3A, the gate rotates downwards, thereby recharging the ballast portion with water via the inlet opening 38 and increasing the closing moment of the gate assembly until sufficiently ballasted to close completely to the position indicated in FIG. 1.

Referring now to FIG. 4, a second embodiment of a top-hung gate in the form of a spillway crest gate 72 is shown. The object of such a gate is to retain a body of water at a required full supply level above a fixed spillway or outlet structure in a dam or weir, thereby increasing the storage capacity thereof.

A one-way flap valve 73 is located at the outlet of the inlet opening 38 at the point where the inlet opening vents into the ballast tank 20. The flap valve 73 is arranged to pivot upwardly to a position indicated in broken outline at 73A on the ingress of water via the inlet opening 38, and is similarly arranged to close in the event of water flowing in the opposite direction from the ballast tank 20. In the event of wave action acting against the downstream wall 22 of the gate, the flap valve 73 will tend to open as the crest of the wave reaches the gate in response to the high hydrostatic forces acting on it, thereby causing water to flow into the ballast tank. However, as the trough of the wave moves against the gate, water will be prevented from flowing out of the ballast tank at the same rate as it flowed in by the action of the flap valve 73 closing due to the high level of water within the ballast tank 20. In this way, the water level in the ballast tank will gradually increase above the normal water level and will provide an additional ballast to keep the gate closed against wave action. In the event of the wave action subsiding, the water level in the ballast tank will return to normal by water leaking back through the flap valve 73, which is not watertight.

In addition to the basic control gate described in FIGS. 1 to 3, the spillway crest gate 72 has a spillway outlet section 74 on top of the ballast tank 20 in order to discharge water resulting from low order storms without opening the gate. The spillway outlet section may constitute a simple discharge launder over the downstream edge of the ballast tank, as is illustrated. Alternatively, it can be re-shaped into a labyrinthine structure with increased discharge capacity for the same plan shape of gate. A baffle plate 76 is provided above the spillway section so as to limit the depth of free discharge before the gate starts opening.

The spillway crest gate 72 operates in the same basic manner as was described with reference to FIGS. 3A to 3D.

As the water level on the upstream side of the gate rises to above a level 78. it starts to discharge through the spillway outlet section 74. Once the level 80 is reached, then the gate will start opening in the manner previously described.

In the unlikely event of the gate not opening at the required level 80, it is provided with an emergency diaphragm valve assembly 82 illustrated in more detail in FIGS. 5A to 5C. If the water reaches the level 84 with the gate not yet having opened, water will flow into a receiving box 86 which discharges water through a vertical pipe 88 to an emergency diaphragm valve 90 which will cause water to be released from the ballast tank 20 in the following manner. As is clear from FIG. 5B, the emergency valve 90 comprises a valve plate 92 which closes off an opening 94 leading from the ballast tank to a discharge outlet 96. A valve plate is connected to an uppermost moveable plate 98 by means of a shaft 100 which passes slidably through a sleeve extending from a lower fixed plate 102. A diaphragm 104 is sandwiched between the moveable and fixed plates 98 and 102, with the fixed plate 102 being provided with an aperture 106 which allows water to flow between the ballast tank and the diaphragm cavity. The vertical pipe 88 terminates in a flexible elbow 108 just before its connection point 110 to the moveable plate 98. As water is fed into the cavity of the diaphragm 104 via the vertical pipe 88. the increase in water pressure due to the elevated position of the inlet box 86 will cause the diaphragm to inflate in the manner indicated in FIG. 5C, thereby lifting the moveable top plate in conjunction with the valve plate 92 and causing water to discharge from the ballast tank through the discharge opening 94. Purging of the ballast tank will naturally cause the gate to lighten significantly, thereby causing the opening moment to exceed the closing moment and allowing the gate to overcome any resisting forces still keeping it closed. If the gate is jammed closed, the ballast tank will be discharged completely, and the opening moment will be of such a magnitude that the gate will be forced open, even with the pivot shafts on the pivot axes being sheared in extreme cases. In this manner, the gate will open and the full spillway capacity will be assured without risking undue stresses on the dam spillway structure.

In FIGS. 6A and 6B, a pivot shaft assembly 112, the only regularly moving part of the top-hung gate of the invention, is shown. The shaft assembly 112 comprises a central solid shaft 114 which is coupled between the pier 12 and the pivot arm 48 by means of respective bearing housings 116 and 118. Each bearing housing comprises two concentric bearings 120 and 122 which are formed from corrosion resistant material having low friction characteristics. The existence of the two concentric bearings results in the provision of three independently rotating surfaces so as to ensure free rotation of the gate assembly relative to the piers. The shaft 114 is formed with a diametrical aperture 124 through which a lever rod 126 may be inserted to as to manually rotate the shaft assembly for testing purposes.

Referring now to FIGS. 6C to 6E, an alternative pivot shaft assembly 127 is shown comprising a semi-cylindrical pivot support cup 128 which has one end anchored firmly within the concrete pier 12. The pivot support cup 128 supports the shaft 114 rotatably both in the closed and open positions illustrated in FIGS. 6C and 6D. A non-structural cover 129 extends over the semi-cylindrical cup 128 so as to prevent the ingress of dirt and the like.

Under normal open and closed conditions, up to, say, a 1:100 year storm event, the reaction of the gate on the pivot support cup is such that the pivot shaft 114 remains seated in the cup 128 without being dislodged. However, in extreme flood situations such as a regional maximum flood where the water level over the spillway is greater than the maximum open position of the gate, the pivot arm 48 of the gate will pivot towards the FIG. 6C position, with the buoyancy forces on the gate causing the shaft to lift up and off the pivot support cup 128. The gate will be washed downstream, thereby saving the dam against any possible structural damage under these extreme flood conditions. This type of pivot arrangement will be used where the depth of the spillway is higher than the maximum opening position of the gate.

In FIG. 7A. a side seal assembly 130 is shown comprising a rubber seal 132 which is bolted to a side wall 134 of the gate by means of an L-shaped clamping plate 136. The seal 132 seals against a seal plate 138 which is cast into the pier 12 as well as a flange plate 140 which is bolted against the seal plate 138. A protection plate 142 extends from the flange plate 140 and serves to protect the seal 132 against debris. Openings 143 are provided in the protection plate 142 so as to ensure that full hydrostatic pressure is exerted on the seal in its closed position in order to effect a tight seal.

In FIG. 7B, a bottom seal assembly 144 is shown comprising a seal 132A bolted by means of a clamping plate 136A to the downstream wall 146 of the gate. A sealing plate 138A is cemented into the spillway 28, and a protection plate 142A provided with openings 143A similarly protects the rubber seal 132A against debris. A support plinth 148, which extends from the downstream wall 146, serves to carry the weight of the gate, thereby relieving the load on the seal.

Maintenance of the top-hung gates of the invention is initiated in the manner illustrated in FIGS. 8A and 8B. An access walkway 150 may be temporarily or permanently fitted above the gate assembly to provide access across the spillway. A crawl winch 154 is temporarily fixed to each pier, and is used to deliver stop logs 156 between opposed vertical guides in the form of H-beams 158 mounted against opposing piers 12 and 14. The stop logs 156 are slotted into the beams 158 so as to form a temporary barrier 159 which effectively closes the waterway off in the manner illustrated in FIG. 8B. The top-hung gate can then be lifted to a partly open position by means of a winch 160 and supported in this position by mean of a suitable array of props 162.

Figure 9:
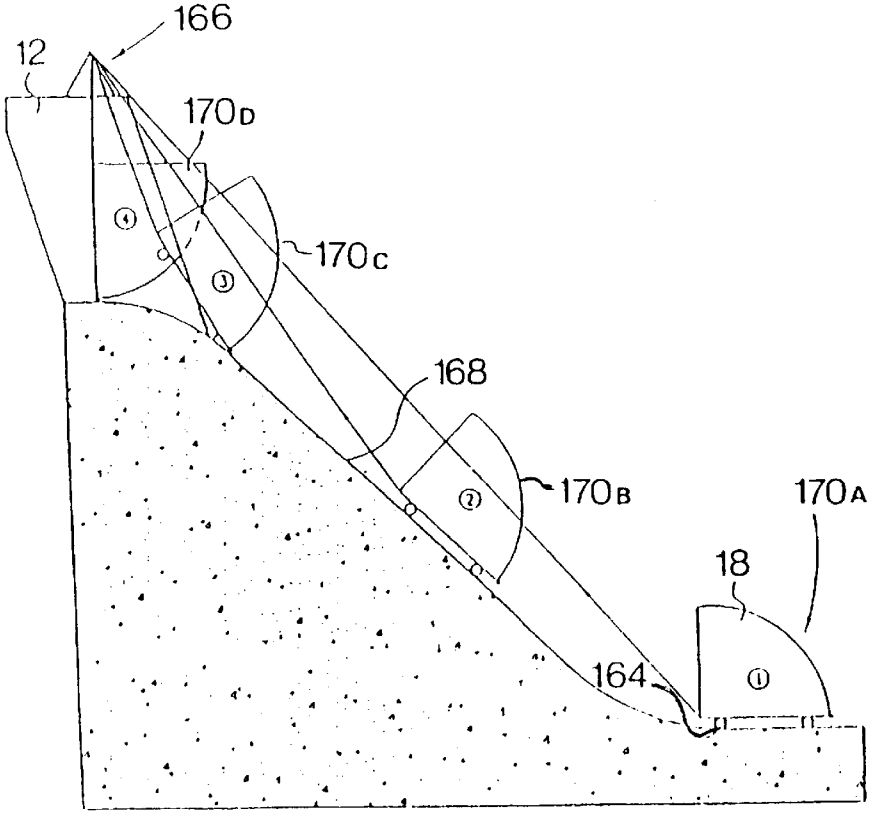
FIG. 9 shows a schematic side view of the one manner in which the top-hung gate of the invention may be installed.

In FIG. 9, various steps involved in the installation of a top-hung gate of the invention are shown. Temporary wheels 164 are fitted to the top-hung gate 18. A winch assembly 166 is fitted to each pier 12, and the top-hung, gate 18 is then winched up the spillway 168 into position, as is illustrated in steps 170A to 170D, thereby avoiding the need for large cranes and the like.

In a spillway crest gate of the type described, all minor floods with a return period of up to approximately one in five years will discharge over the top of the gate without the gate opening. This will ensure that debris is not lodged between the bottom seal of the gate and the spillway in the case of more frequent storms. As was previously described. the gate will only open further as a result of further increases in the upstream water level, with such an increase in water level ensuring that the flood peak is attenuated by the increase in storage capacity in the dam.

The structural stability of the spillway section is not adversely affected to any extent as a result of the increased depth of water over the spillway. The ballasted gate provides a predominantly vertical force component on the pivot axes, which largely offsets the horizontal hydrostatic force on the gate. Maintenance of the only portion of the gate which requires regular maintenance, namely the shaft assemblies, is possible, except under extreme flood conditions, in view of the elevated position of the shaft assemblies above the water level.

Figure 10:
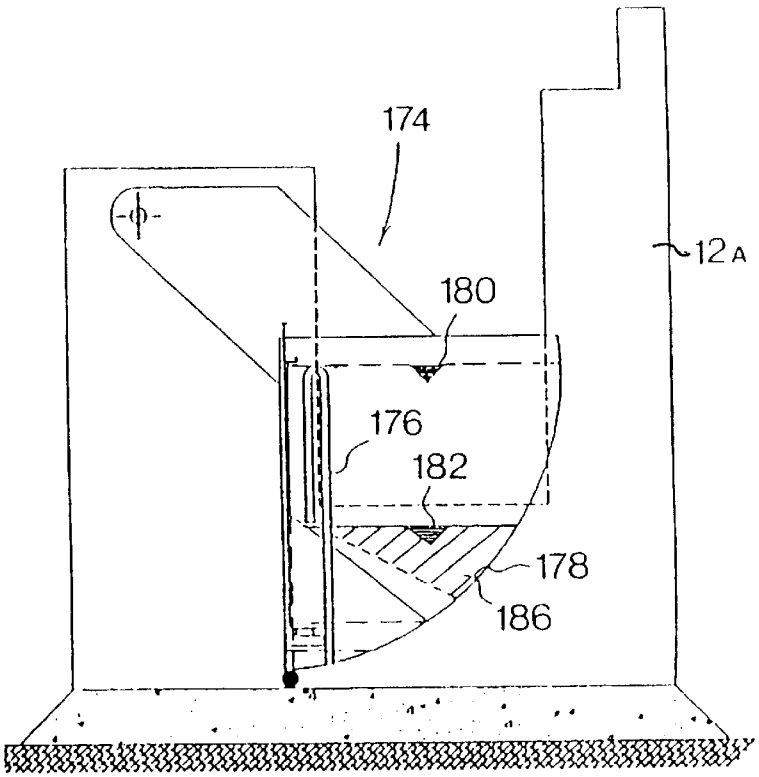
FIG. 10 shows a schematic side view of a weir scour gate forming a second main embodiment of a top-hung gate of the invention.

Referring now to FIG. 10, a second main embodiment of a top-hung gate in the form of a weir scour gate 174 is shown. This gate is similar in operation to the aforementioned spillway crest gate its main purpose being to maintain a full supply level of a river upstream of a weir structure under low flow conditions and to open fully under flood conditions so as to scour out the river reach and to allow flotsam and other forms of debris to pass. The weir scour gate 174 is provided with a quick opening facility in the form of a syphon pipe 176 which causes rapid draining of the ballast tank 178, thereby permitting the gate to open more fully to allow passage of the flood. As the water level rises above the full supply level 180, the syphon will be primed to discharge the ballast tank to a level 182 when the gate is in the closed position. after which the vacuum seal to the syphon will be broken and no further discharge will occur. Under normal conditions, the gate will open well before the syphon has discharged completely, with the result that an even greater volume of water 186 will be discharged before the seal is broken.

Figure 11A:
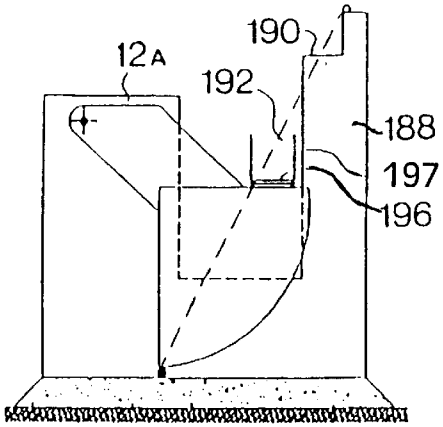
FIGS. 11A & 11B show schematic side views illustrating how the weir scour gate is optionally raised during rainy seasons to ensure the unobstructed passage of floods.
Figure 11B:
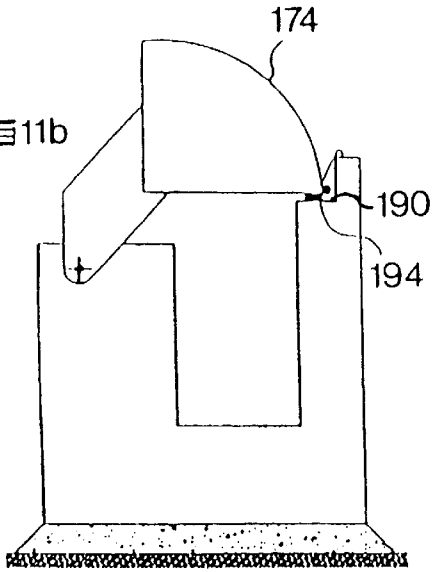

As is clear from FIGS. 11A and 11B, the support piers 12A may include a downstream column 188 which is formed with a landing 190 upon which the weir scour gate 174 may be supported once it has been winched upwardly into a fully open position by means of a winch assembly 192. In the fully open position illustrated in FIG. 11B, the gate 174 rests on a support block 194 on the landing 190. The gate is optionally raised to its position to provide an unobstructed waterway for the weir during the rainy season. An access way 196 may be provided on top of the gate 174. In the case of larger weirs, this access way may even by designed to accommodate vehicles 198.

Figure 12A:
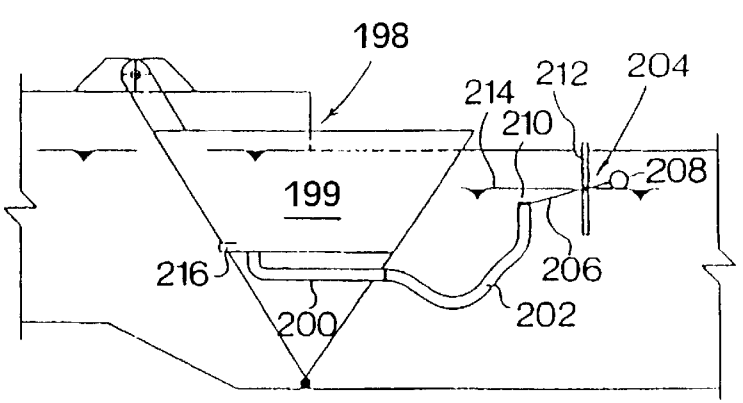
FIGS. 12A & 12B show schematic side views of a third embodiment of a top-hung gate of the invention in the form of a level control canal gate in the respective open and closed positions.
Figure 12B:
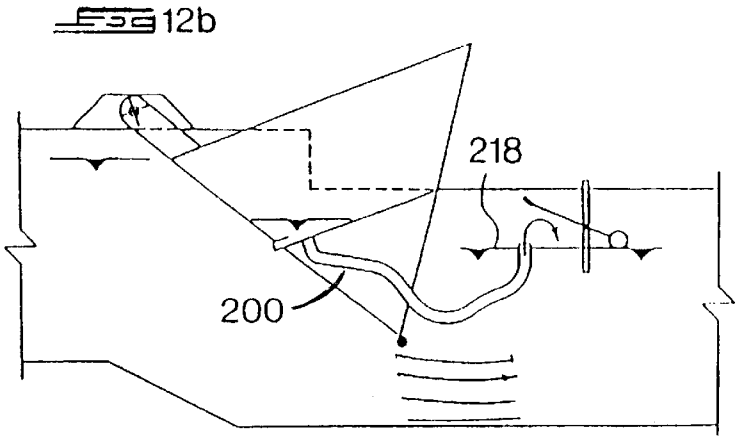

Referring now to FIGS. 12A and 12B, a third main embodiment of the top-hung gate in the form of a level control canal gate 198 is shown. The purpose of this gate is to control water levels both up and downstream in level reaches of open channels or canals. The gate operates in the same basic manner as the previously described gates. A ballast tank 199 is provided with an outflow pipe 200 having a flexible section 202 connecting it to an outlet control float valve 204. The valve 204 comprises a pivot arm 206 having a float 208 at one end and a closure plate 210 at the other end which is arranged to close off the opening of the flexible pipe 202. The fulcrum of the pivot arm 206 is connected to a vertical guide 212 for facilitating vertical adjustment of the pivot arm. When a high water level 214 is reached on the downstream side of the gate, the upward movement of the float 208 causes the closure plate 210 to close off the opening of the flexible pipe 202, thereby ensuring that there is no discharge from the ballast tank 199. The tank 198 fills up with upstream water via an inlet pipe 216, which increases the closing moment of the gate 198 so as to ensure it remains closed.

Referring now to FIG. 12B, in the event of the water level dropping to a level 218 below the level 214, the float valve 204 opens, thereby allowing water in the ballast tank to be discharged via the outlet pipe 200, with the resultant reduction in the closing moment causing the gate 198 to open. In this manner, the water level on the downstream side of the gate can be maintained.

Referring now to FIGS. 13A and 13B, respective closed and open positions of a fourth main embodiment of a top-hung gate in the form of an estuarine control gate is shown. The purpose of such a gate is to maintain a full supply level in an estuary so as to suit environmental and recreational requirements. Such a gate is designed to open automatically under flood conditions so as to discharge flood waters into the sea. and similarly to open when the tidal level exceeds the level in the estuary so as to allow tidal water to enter the estuary and not to disrupt its natural ebb and flow cycle. The estuarine control gate also allows the estuary mouth to be manually or automatically flushed during low tide for a limited period in order to prevent the estuary mouth from being blocked.

Under normal flow conditions, the water level 220 upstream of the gate 222 is maintained with a downstream valve 224 closed while the sea level 226 is below the estuary level 220. During flood conditions through the estuary, the gate behaves in exactly the same manner as the spillway gate, with water in the ballast tank 228 discharging via a discharge launder 230 so as to facilitate opening of the gate. Under reverse tidal conditions illustrated in FIG. 13B, in which the sea level 232 is greater than the estuary level 234, hydrostatic forces on the seaward side of the gate are sufficient to rotate the gate upwards, thereby causing water to be decanted from the ballast tank 228 through what was the inlet 236 into the estuary side of the gate. The gate will rotate further with increased lightening of the ballast so as to provide sufficient opening beneath the gate to allow the ingress of sea water into the estuary and the transfer of fish and other aquatic life between the two water bodies.

The valve 224 is a diaphragm valve similar to that provided in the spillway and weir gates. The outlet pipe 236 from the valve is provided with a timer valve 238 which is set each week to coincide with one of the low tides. The timer valve will open at the preset time, thereby causing the diaphragm valve 224 to open and to release water from the ballast tank. The gate will consequently open and the discharge of water from the estuary will be sufficient to scour away any sand deposits which may have been formed at the mouth of the estuary. The timer valve 238 is set to open for a relatively short duration of approximately ten minutes and then to close, thereby causing the gate 222 to close slowly as water from the estuary side of the gate travels through the inlet 236.

Referring now to FIGS. 14A and 14B, a fifth embodiment of a top-hung gate in the form of a tidal control gate 240 is shown. This gate is designed to allow inland water to flow out to sea when the sea level is below the inland water level, and to close off the gate to prevent tidal sea water from flowing inland when the sea level is at a predetermined level above the inland water level. In FIG. 14A. the inland water level 242 is higher than the water level 244 on the seaward side, thereby causing water to decant through the outlet launder 230 and allowing inland water to flow out to sea.

In FIG. 14B, the sea water level 246 is higher than the inland water level 248. A seal in the form of a flexible plate 250 extends from the base of the gate. This plate serves as a reaction plate which causes a downward drag on the gate as water flows from the seaward side of the gate. The plate 250 also serves as a guide to guide water back up the outlet launder 230 into the ballast tank 252 in the direction of arrow 254. As the ballast tank fills, the gate will tend to close completely, thereby protecting the inland body of water from high tidal flows.

The gate 240 may be modified further so as to allow the gate to remain open for a certain range of high tide levels so as to meet environmental requirements by allowing the ingress of salt water into the estuarine wetland system. In this embodiment, a stop beam 256 is attached to the side supports of the gate, and the flexible plate 250 is replaced by a normal seal of the type previously described. The gate will tend to float in response to increasing water levels either on the inland or seaward side until it rotates against the stop beam 256, when further upward movement of the gate is prevented. This will cause the ballast tank to flood in response to an increase in sea level, which will in turn cause the gate to rotate downwards so as to close off the opening. As the sea level recedes, the ballast tank will empty and the buoyancy of the gate will increase so as to allow water to pass beneath the gate.

The various versions of the top-hung gate of the invention have a number of advantages over existing gates.

The operation of the gates is totally automatic, with no external source of power being required to operate or activate the gates.

Immediately after operation in response to flooding on the upstream or downstream side of the gate, the gates tend to restore themselves to retain the required upstream or downstream water level.

Water is used as a variable ballast to provide the required closing moment. As a result, no fixed mechanical counter-weights are required. and the gate can therefore have a lighter constructs The only regularly moving parts are the pivot assemblies. As these are located above the normal water level, they can be inspected and maintained on a regular basis. If necessary, the gates can be operated manually or by remote control. This is an important feature as it allows for frequent testing of the gate in order to ensure that it is operational. Naturally, the lighter construction of the gate makes for easier testing than in the case of a gate with mechanical counter-weights.

The various features described in the specification with reference to a particular type of gate can be optionally interchanged so as to meet operational requirements. For instance, the syphon outlet could be used in a spillway gate and the emergency diaphragm valve could similarly be used in a weir scour gate.

What is claimed is:

1. A water control gate assembly comprising a self-opening and self-closing top-hung gate for controlling the flow and level of water in a waterway, and a pivot arrangement located above and upstream of the gate for allowing the gate to pivot between a closed position and an open position in which water flows beneath the gate, the gate including a ballast tank having an upstream inlet operative automatically to charge the ballast tank so as progressively to increase the closing moment of the gate and to maintain it closed against an increase in opening moment arising from an increase in upstream water level and a downstream outlet operative automatically to discharge the ballast tank so as to decrease the closing moment of the gate and to assist in opening of the gate in the event of a further increase in upstream water level beyond a predetermined upper level.

2. A water control gate assembly a according to claim 1 in which the upstream inlet is arranged automatically to start charging the ballast tank with water in the event of the upstream water level reaching a first lower level, and the downstream outlet is arranged automatically to start discharging the ballast tank in the event of the upstream water level exceeding the predetermined upper level, with the ingress of water into the ballast tank between the first and second levels progressively increasing the closing moment of the gate and maintaining the gate closed against the progressively increasing opening moment of upstream water pressure against the gate.

3. A water control gate assembly according to claim 2 in which the gate is arranged automatically to start opening when the water level approaches the predetermined upper level, and the downstream outlet is configured to progressively discharge water from the ballast as the gate tilts progressively upwards.

4. A water control gate assembly according to claim 2 in which the gate is formed with an emergency discharge valve which is arranged to void the ballast tank in the event of the gate failing to open after the gate has reached a third flood level which is higher than the second upper level.

5. A water control gate assembly according to claim 2 in which the downstream outlet includes at least one discharge launder extending downwardly adjacent an upstream wall of the gate, the discharge launder having an inlet towards the top of the gate and an outlet at the base of the gate.

6. A water control gate assembly according to claim 2 which comprises a weir scour gate with the downstream outlet comprising a self-actuating siphon arrangement which allows for almost complete discharging of the ballast tank after priming of the siphon arrangement so as to cause rapid opening of the gate.

7. A water control gate assembly according to claim 1 in which the upstream inlet, the down stream outlet and the ballast tank are arranged automatically to operate in the opposite manner on closure of the gate, with the upstream inlet progressively filling the ballast tank and the downstream outlet no longer being capable of discharging water from the ballast tank as quickly as the ballast tank is being filled via the upstream inlet as the gate pivots downwards.

8. A water control gate according to claim 1 in which the ballast tank occupies an upper portion of the gate, and a lower portion of the gate comprises a permanent buoyancy chamber which is separated from the ballast tank by means of a wall which slopes downwardly from the upstream to the downstream side of the gate.

9. A water control gate assembly according to claim 8 in which the upstream inlet includes at least one inlet pipe arranged to fill the ballast tank from the base upwards.

10. A water control gate assembly according to claim 1 which comprises a pair of support piers located on opposite sides of the gate and extending above the gate, the pivot arrangement including pivot shaft assemblies pivotably connecting each pier to the top-hung gate via upwardly and rearwardly extending arms.

11. A water control gate assembly according to claim 10 in which the gate is formed with side and bottom seal arrangements attached to the gate for sealing the respective sides and base of the gate against the respective inner side walls of the support piers and the bed of the waterway.

12. A water control gate assembly according to claim 10 which includes detachment means for allowing the top-hung gate to detach by floating upwardly from the piers under extreme flood conditions.

13. A water control gate assembly according to claim 12 in which the detachment means comprises a substantially U-shaped support cup arrangement extending from each pier for allowing free upward movement of the pivot shaft assembly under extreme flood conditions.

14. A water control gate assembly according to claim 1 in which the water control gate assembly is in the form of a spillway crest gate, the gate being formed with a spillway outlet above the ballast tank for discharging water over the gate without opening the gate.

15. A water control gate assembly according to claim 14 in which a baffle plate is located above the spillway outlet so as to limit the depth of free discharge before the gate starts opening.

16. A water control gate assembly according to claim 1 which comprises a tidal control gate, the gate being arranged to close in the event of the downstream water level exceeding the upstream level by a predetermined increase in downstream or seaward level of water.

17. A water control gate assembly according to claim 1 which comprises an estuarine control gate arranged to open in response to the downstream water level exceeding the upstream water level.

18. A water control gate assembly according to claim 1 which comprises a level control canal gate, the downstream outlet being provided with valve means arranged automatically to close the outlet in the event of the downstream water level reaching a predetermined upper level, thereby allowing the ballast tank to fill and to increase the closing moment of the gate, the valve means being further arranged automatically to open the outlet in the event of the downstream water level failing below a predetermined lower level, thereby to increase the opening moment of the gate.

* * * * *